US006416918B2

(12) United States Patent
Matsumura et al.

(10) Patent No.: US 6,416,918 B2
(45) Date of Patent: Jul. 9, 2002

(54) TONER FOR DEVELOPING ELECTROSTATIC IMAGE, PROCESS FOR PRODUCING THE SAME, FINE RESIN PARTICLE DISPERSION, RELEASING AGENT DISPERSION, DEVELOPER FOR DEVELOPING ELECTROSTATIC IMAGE, AND PROCESS FOR FORMING IMAGE

(75) Inventors: Yasuo Matsumura; Hisae Yoshizawa; Hideo Maehata; Masaaki Suwabe; Yasuo Kadokura, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/798,996

(22) Filed: Mar. 6, 2001

(30) Foreign Application Priority Data

Mar. 14, 2000 (JP) ..... 2000-069965

(51) Int. Cl.[7] ..... G03G 9/097
(52) U.S. Cl. ..... 430/110.4; 430/126; 430/137.14
(58) Field of Search ..... 430/110.4, 137.14, 430/126

(56) References Cited

U.S. PATENT DOCUMENTS 5,512,402 A * 4/1996 Okado et al. ..... 430/110.4
6,022,662 A 2/2000 Matsumura et al.
6,258,502 B1 * 7/2001 Nakamura et al. ..... 430/110.4

FOREIGN PATENT DOCUMENTS

| | | |
|---|---|---|
| JP | A 63-282752 | 11/1988 |
| JP | A 4-324868 | 11/1992 |
| JP | A 6-250439 | 9/1994 |
| JP | A 10-301323 | 11/1998 |

* cited by examiner

*Primary Examiner*—John Goodrow
(74) *Attorney, Agent, or Firm*—Oliff & Berridge, PLC

(57) ABSTRACT

A toner for developing an electrostatic image, a developer for developing an electrostatic image, a process for producing them, and a process for forming an image that provide excellent developing and transferring performance and also provide excellent performance stability, as well as high image quality and reliability are provided. The problem can be solved by a toner for developing an electrostatic image having a particle size distribution index on a small particle side GSDpS in number distribution of a particle diameter of about 1.27 or less, GSDpS is D50p/D16p, D50p represents a particle diameter providing, a particle diameter accumulation in number distribution of 50%, and D16p represents a particle diameter providing a particle diameter accumulation in number distribution of 16% from a small diameter side.

21 Claims, No Drawings

TONER FOR DEVELOPING ELECTROSTATIC IMAGE, PROCESS FOR PRODUCING THE SAME, FINE RESIN PARTICLE DISPERSION, RELEASING AGENT DISPERSION, DEVELOPER FOR DEVELOPING ELECTROSTATIC IMAGE, AND PROCESS FOR FORMING IMAGE

FIELD OF THE INVENTION

The present invention relates to a toner that is used for developing an electrostatic latent image formed by an electrophotographic process or an electrostatic recording process, and a process for producing the same.

BACKGROUD OF THE INVENTION

A method for visualizing image information through an electrostatic image, such as an electrophotographic process, is being applied to various fields of art. In the electrophotographic process, an electrostatic image is formed on a photoreceptor by charging and exposing steps and then developed with a developer containing a toner, followed by visualizing an image through transferring and fixing steps. The developer used herein includes a two-component developer formed with a toner and a carrier, and a one component toner using a magnetic toner or a non-magnetic toner solely. As a production process of a toner used in these developers, a kneading and pulverization method is employed, in which a thermoplastic resin is melted and kneaded with a pigment, a charge controlling agent and a releasing agents such as a wax, and after cooling, the mixture is finely pulverized and then classified. Inorganic fine particles or organic fine particles are added depending on necessity to the surface of the particles of the toner for improving the fluidity and tho cleaning property.

The toner shape and the surface structure of the toner formed by the ordinary kneading and pulverization method are in an irregular form and are subtly changed depending on the pulverization property of the materials used and the conditions in the pulverization step. Therefore, it is generally difficult to control to the desired toner shape and the desired surface structure. Particularly, in the case where the toner is formed with a material of high pulverization property, it often occurs that a toner in a further fine particle form is formed, or the toner shape is changed. Under the influence of these phenomena, the developing property of the toner is lowered due to the change in toner shape, for example, the fine particles stick on the surface of the carrier to accelerate deterioration of charge in the case of the one component toner, and the particle size distribution is broadened to cause scattering of the toner, and as a result, deterioration in image quality is liable to occur. In the case where the toner is formed by internally adding a releasing agent, such as wax, while depending on the combination with a thermoplastic resin, the releasing agent is exposed on the surface of the toner to adversely affect Particularly, in the case of the combination of a resin that is somewhat difficult to be pulverized by imparting elasticity with a high molecular weight component and brittle wax, such as polyethylene, exposure of the polyethylene on the surface of the toner is often observed. Although this is advantageous in releasing property on fixing and cleaning of a non-transferred toner from a photoreceptor, the polyethylene on the surface layer is easily transferred to various members by a mechanical force, contamination of a developer roll, a photoreceptor and a carrier is liable to occur, which causes deterioration in reliability.

Furthermore, because the toner shape is irregular, the fluidity cannot be sufficiently established even by adding a fluidizing aid, and the fine particles on the surface of the toner migrate to concave parts of the toner by a mechanical force on use to lower the fluidity with the lapse of time. The developing property, the transferring property and the cleaning property are deteriorated by burying the fluidizing aid into the interior of the toner. Moreover, deterioration in image quality is liable to occur when the toner recovered by cleaning is returned to a developing device and reused. When the amount of the fluidizing aid is increased to prevent the problems, formation of black spots on the photoreceptor and scattering of the particles of the aid occur.

In recent years, a process for producing a toner by an emulsion polymerization aggregation process is proposed in JP-A-63-282749 and JP-A-6-250439 as a method capable of controlling the toner to have a desired toner shape and a desired surface structure. In the process, generally, a resin dispersion is produced, for example, by emulsion polymerization, and is colorant dispersion is separately produced by dispersing a colorant in a solvent, both of which are mixed to form aggregated particles corresponding to a toner particle diameter, followed by fusing by heating to produce a toner. In the method, however, since the surface and the interior of the toner have the same composition, it is difficult to intentionally control the composition of the surface of the toner.

As described in the foregoing, in order to maintain stable performance of the toner under various kinds of mechanical stress in the electrophotographic process, it is necessary to increase the surface hardness or further increase the smoothness of the surface. In order to exert the performance of the releasing agent, it is desirable that it is not exposed to the surface but is present in the vicinity of the surface upon fixing.

There are various problems with respect to the particle size distribution of the toner in the electrophotographic process. The problems include the breakage of the toner by the mechanical force aforementioned, and when the particle size distribution of the toner itself is broad, it influences on the particle size selectivity upon developing, generation of scattering in transferring and easiness in cleaning.

When the particle size distribution is broad in the case of the one-component developer, contamination of a developer roll, a charging roll and a charging blade is liable to occur, and the influence of the fine particle side tends to cause a problem.

Furthermore, a toner having a broad particle size distribution is poor in reliability in a system where a recovered toner by cleaning is reused.

The volume average or number average GSD has been conventionally used as an index for the particle size distribution. With respect to the index, it has been found that an index, GSDpS=D50p/D16p, indicating an extent of tailing on the small diameter side in the number average GSD is important.

SUMMARY OF THE INVENTION

The invention has been made to solve the problems associated with the conventional toners and to provide a toner for developing an electrostatic image, a process for producing the same, a developer for developing an electrostatic image and a process for forming an image.

In other words, the invention is (1) to provide excellent developing and transferring properties, (2) to obtain excellent performance stability and to provide high image quality and high reliability, (3) to provide a two-component developer of a long service life that is difficult to cause carrier contamination, (4) to provide a developer of a small consuming amount of a toner owing to a high transferring efficiency, (5) to provide a one-component toner that is difficult to bring about contamination of a developer roll, a charging roll and a charging blade, (6) to provide a toner or a developer used in a toner recycling system, i.e., a system where a toner recovered from a cleaner is reused, which is a toner or a developer exhibiting high reliability, and (7) to provide high image quality in a cleanerless system, in., a system having no cleaning mechanism.

According to one aspect, the invention relates to a toner for developing an electrostatic image containing a binder resin and a pigment. The toner particles have a particle size distribution index on a small particle side GSDpS in number distribution of a particle diameter represented by the following equation (I) of about 1.27 or less:

$$GSDpS=D50p/D16p \quad (I)$$

wherein D50p represents a particle diameter providing a particle diameter accumulation in number distribution of 50%, and D16p represents a particle diameter providing a particle diameter accumulation in number distribution of 16% from a small diameter side,.

According to another aspect, the invention provides a process for producing a toner containing a step of forming a first resin particle dispersion containing binder resin particles and of forming aggregated particles by aggregating the first particles, and a step of fusing the aggregated particles by heating, so as to form a toner particles, the toner particles having a particle size distribution index on a small particle side GSDpS in number distribution of a particle diameter represented by the following equation (I) of about 1.27 or less:

$$GSDpS=D50p/D16p \quad (I)$$

wherein D50p represents a particle diameter providing a particle diameter accumulation in number distribution of 50%, and D16p represents a particle diameter providing a particle diameter accumulation in number distribution of 16% from a small diameter side.

According to still another aspect, the invention provides a fine resin particle dispersion containing fine resin particles having a Zeta potential of −50 mV or less in a dispersion of pH 2.5.

According to a further aspect, the invention provides a releasing agent dispersion having a releasing agent dispersed therein. The releasing agent, particles have a volume average particle diameter in a range of about from 100 to 300 nm, and have a particle size distribution index on a small particle side GSDvS and a particle size distribution index on a large particle side GSDvL in volume distribution of a particle diameter represented by the following equations (III) and (IV), respectively, both of which are about 2.0 or less:

$$GSDvS=D50v/D16v \quad (III)$$

wherein D50v represents a particle diameter providing a particle diameter accumulation in volume distribution of 50%, and D16v represents a particle diameter providing a particle diameter accumulation In volume distribution of 16% from a small diameter side $$GSDvL=D50v/D84v \quad (IV)$$

wherein D50v represents a particle diameter providing a particle diameter accumulation in volume distribution of 50%, and D84v represents a particle diameter providing a particle diameter accumulation in volume distribution of 84% from a small diameter side.

According to a still further aspect, the invention provides a developer for developing an electrostatic image containing a toner a carrier, the toner containing a binder resin and a pigment and toner particles having a particle size distribution index on a small particle side GSDpS in number distribution of a particle diameter represented by the following equation (I) of about 1.27 or less:

$$GSDpS=D50p/D16p \quad (I)$$

wherein D50p represents a particle diameter providing a particle diameter accumulation in number distribution of 50%, and D16p represents a particle diameter providing a particle diameter accumulation in number distribution of 16% from a small diameter side.

According to a still further aspect, the invention provides a process for forming an image containing a step of forming an electrostatic image on an electrostatic latent image holding member, a step of developing the electrostatic latent image with a developer to form a toner image on a developer holding member, and a step of transferring the toner image to a transfer material, the developer containing a toner particles having a particle size distribution index on a small particle side GSDpS in number distribution of a particle diameter represented by the following equation (I) of about 1.27. or less:

$$GSDpS=D50p/D16p \quad (I)$$

wherein D50p represents a particle diameter providing a particle diameter accumulation in number distribution of 50%, and D16p represents a particle diameter providing a particle diameter accumulation in number distribution of 16% from a small diameter side.

DETAILED DESCRIPTION OF THE INVENTION

The invention will be described in detail below.

The toner for developing an electrostatic image of the invention may be used solely as a one-component developer or may be used as a two component developer along with a carrier.

The toner for developing an electrostatic image of the invention has a particle size distribution index on a small particle side GSDpS in number distribution of a particle diameter represented by the equation (I) of about. 1.27 or less, preferably 1.26 or less, and more preferably 1.25 or less.

In the developing and/or transferring properties of a toner, the content of fine particles thereof generally exhibits large influence on performance and reliability. That is, as has been known, a toner having a small diameter has a large adhesion force and thus is difficult to be electrostatically controlled, whereby it is liable to remain on a carrier when it is used as a two-component developer. When a mechanical force is repeatedly applied, it causes carrier contamination, and as a result, deterioration of the carrier is accelerated. Furthermore, since the toner having a small diameter has a large adhesion force, it causes deterioration in developing efficiency, and as a result, image defects are formed. In the transferring step, it is liable that a small diameter component of the toner developed on a photoreceptor is difficult to be transferred to impair the transferring efficiency, and thus increase in waste toner and deterioration In image quality are caused.

The GSDpS represented by the equation (I) is an index that has been found by the inventors for solving the problems, It has been found that when the value thereof is in the range specified above, the problems are solved.

A process for producing the toner is not particularly limited as far as the GSDpS of the toner is in the range, and it may be a toner obtained by the conventional kneading and pulverization process, a toner obtained by forming particles by suspension polymerization, or a toner obtained by a process called dispersion polymerization. For example, in the case of the conventional kneading and pulverization process, it is preferred that a toner obtained by pulverization is subjected to classification operation in plural times.

A production process of toner using suspension polymerization may also be used, in which a monomer, such as styrene, a pigment and wax are dispersed in water by applying a sharing force, and then polymerized by heating to form particles. In this case, because the mechanical force (sharing force) is dominant in the formation of particles as similar to the kneading and pulverization process, the particle size distribution of the resulting particles is liable to be broadened. Therefore, in order to obtain a toner satisfying the range, it is preferred to conduct classification operation as similar to the kneading and pulverization process.

A process for producing a toner having a narrow fine particle size distribution without depending on a mechanical force includes a process called dispersion polymerization. In this method, deposition polymerization is conducted in a medium dissolving a monomer. While the process involves problems in that a large amount of an organic solvent is necessary as polymerization medium and a method for coloring the toner is, restricted, the invention includes a toner obtained by this process.

A production process of a toner by an emulsion polymerization aggregation process is also proposed. The invention includes a toner obtained by this process. The process is described in JP-A-63-282752 and JP-A-6-250439 and can realize a narrow fine particle size distribution in this process, a resin dispersion is prepared, for example, by emulsion polymerization, and a colorant dispersion having a colorant dispersed in a solvent is separately prepared, both of which are then mixed to form aggregated bodies corresponding to the particle diameter of the toner, followed by beating to fuse them, so as to produce the toner. In this process, a releasing agent may be contained in the toner depending on necessity. In this case, a releasing agent dispersion having a releasing agent dispersed therein is prepared separately from the resin dispersion and the colorant dispersion, and it is mixed with the dispersions, followed by subjecting to the formation of the aggregated bodies.

It is preferred that the toner for developing an electrostatic image of the invention has, in addition to the GSDpS, a surface property index represented by the following equation (II) of 2.0 or less, preferably 1.8 or less, and more preferably 1.6 or less.

The surface property index is an index showing the extent of smoothness of the surface of the toner and expressed by the equation (II):

(Surface property index)=(Measured specific surface area)/(Calculated specific surface area)

In the equation (II), (Calculated specific surface area) is $6E(n\times R^2)/[\rho\times E(n\times R^5)]$, wherein n represents a number of particles in a channel of la Coulter counter, R represents a channel particle diameter in a Coulter counter,. and ρ represents a density of a toner. In other words, the calculated specific surface area indicates a specific surface area calculated in terms of sphere conversion with consideration of the particle size distribution.

In the equation (II), (Measured specific surface area) is a measured. value obtained by the BET method. The surface property index obtained from these values theoretically becomes 1.0 in the case where the resulting particles are perfect smooth spheres. However, there are actually cases where it becomes a value lower than 1.0 due to errors on measurements of the particle size distribution and the BET specific surface area.

In general, a toner is formed by adhering inorganic fine particles or organic fine particles having an average particle diameter of 200 nm or less, such as silica, titanium oxide or a resin, on the surface thereof, whereby not only the fluidity of the toner is improved, but also the actual contact area of the toner with a photoreceptor and an intermediate transfer body is decreased, so as to improve the transferring property, which brings about improvement in uniformity in density of a solid image area and reproducibility of thin lines. In the case where the surface of the toner is not smooth, the fine particles easily move to concave parts of the toner upon developing, so as to fail to accomplish the objective effect. Therefore, particularly in the case of a toner of a small diameter of 7 μm or less, it is preferred that the surface property index is in the range specified above.

The surface property index depends on the conditions upon fusing the aggregated particles and the conditions upon washing. The surface property index also depends, in the emulsion polymerization aggregation process using the dispersions, on various conditions including the dispersion particles, such as the binder resin particles, the colorant, e.g., a pigment, and the releasing agent. It is preferred that the conditions satisfy the following requirements.

The binder resin particles preferably have, in a dispersion having the binder resin particles dispersed therein, pH of 2.5 and a zeta potential of the binder resin particles of −50 mV or less, and preferably −55 mV or less. While the lower limit thereof is not clear, the similar effect is found in the range from −55 to −100 mV to contribute to narrow the particle size distribution of the aggregated particles. The dispersion having the zeta potential in the range specified above has good dispersion stability and is excellent in storage stability. The volume average particle diameter of the binder resin particles is preferably from 100 to 400 nm, but the zeta potential contributes to narrow the particle size distribution in a large extent.

The smaller content of the fine particles of smaller diameters in the aggregated particles theoretically agrees to the tendency of improving the surface property index defined in the foregoing.

In the emulsion polymerization aggregation process using the above dispersion the binder resin particles, the colorant particles, such as a pigment, and the releasing agent particles, such as wax are generally charged fine particles in a water dispersion. The aggregation is conducted by adding an aggregation agent having the charge opposite to the fine particles or by making different the polarities of charge of the respective particles to balance out the charge. In this method, therefore, the interaction caused by change greatly influences on the particle size distribution. The shearing force, which dominates the fluidity of the particles, the uniformity of the system and the uniformity of the temperature, becomes a secondary factor.

Therefore, it is preferred to use the zeta potential as a quantitative index for the charge interaction dominating the particle size distribution. The zeta potential depends on the charge index owned by the respective particles and the size of the particles themselves.

In the case where a releasing agent is contained in the toner and the releasing agent is supplied in the form of a dispersion, it is preferred that the volume average particle diameter of the releasing agent in the dispersion is from 100 to 300 nm, more preferably from 100 to 250 nm, and particularly preferably from 100 to 200 nm.

When the volume average particle diameter is too small (when it is less than 100 nm), the releasing agent, such as wax, is liable to dissolve in the binder resin to cause a tendency of extremely decreasing the releasing effect upon fixing after forming the toner. There is also a tendency of decreasing the Tg of the binder resin to cause a problem in the powder: fluidity. When the volume average particle diameter is too large (when it exceeds 300 nm), there is a tendency of deteriorating the GSD upon aggregation and fusing. There is also a tendency of exposing the releasing agent on the surface, whereby the surface property index is deteriorated, and as a result; deterioration in powder fluidity and reduction in transfer efficiency tend to occur.

The particles of the releasing agent preferably has, in the dispersion, a particle size distribution Index on a small particle side GSDvS and a particle size distribution index on a large particle side GSDvL in volume distribution: of a particle diameter represented by the following equations (II) and (IV) respectively, both of which is about 2.0 or less, and preferably 1.8 or less;

$$GSDvS=D50v/D16v \quad (III)$$

wherein D50v represents a particle diameter providing a particle diameter accumulation in volume distribution of 50%, and D16v represents a particle diameter providing a particle diameter accumulation in volume distribution of 16% from a small diameter side $$GSDvL=D50v/D84v \quad (IV)$$

wherein D50v represents a particle diameter providing a particle diameter accumulation in volume distribution of 50%, and D84v represents a particle diameter providing a particle diameter accumulation in volume distribution of 84% from a small diameter side.

When the GSDvS is too large, the releasing agent is liable to dissolve in the binder resin to cause a tendency of extremely decreasing the releasing, effect upon fixing after forming the toner. When the GSDvL is too large, the GSD upon aggregation and fusing is liable to become poor due to the influence of the coarse powder, and there is a tendency of exposing the releasing agent on the surface, whereby deterioration in powder fluidity and reduction in transfer efficiency tend to occur. The dispersion satisfying the dispersion conditions specified above does not cause precipitation of coarse particles and aggregated particles, and can maintain the dispersion stability for a long period of time. It is also excellent in dispersion stability.

While materials used as the releasing agent will be described later, the values are particularly effective when it Waxy resin is used as the releasing agent.

The particle size distribution of the colorant particles is preferably controlled in tie dispersion thereof. In the dispersion having the colorant, such as a pigment, dispersed therein it is preferred that the volume average particle diameter of the colorant particles is from 70 to 250 nm, preferably from 80 to 200 nm, and more preferably from 90 to 150 nm.

When the volume average particle diameter is too large (when it exceeds 250 nm), there is a tendency of lowering the transparency after forming an image particularly in color toners of cyan, magenta and yellow, and in the case where they are used on a transparency, it is not preferred since turbid indication state occurs. There is also a tendency of deteriorating the GSD, particularly GSDpS, to cause the problems.

When the volume average particle diameter is too small (when it is less than 70 nm), it exhibits fusing preventing effect upon fusing the toner to cause a tendency of making difficult to control the shape. There is also a tendency that the surface property index is deteriorated to roughen the surface of the toner, so as to reduce the effect of the use of an external additive, whereby the fluidity is deteriorated and background fogging occurs.

In the production process of the toner, particularly in the production process of the toner using the emulsion polymerization aggregation process, when part or all of the requirements are satisfied, a toner having a narrow particle size distribution as the GSDpS of 1.27 or less can be relatively easily obtained without additional operation, such as classification.

The zeta potential of the binder resin particles can be controlled by the following manners, ice., (i) the amount of a surface active agent used in the emulsion polymerization aggregation process is adjusted and/or (ii) a dissociative polymer acid is mixed with a vinyl series monomer used in the polymerization and is incorporated in the resin particles as a copolymer upon polymerization, as well as (iii) the amounts of sulfuric groups and sulfone groups remaining on the polymer ends of the resin are adjusted by the used amount of a polymerization initiator.

When a dispersion is obtained by dispersing a releasing agent, particularly a waxy resin, in a liquid containing water, it is particularly effective to use a heating discharge type homogenizer (such as Gaulin homogenizer produced by Meiwa Shoji Co., Ltd.). The particle size and the distribution thereof depend on the amount of the dispersing agent, the temperature, the pressure and the number of dispersion passes.

The similar disperser as above can be used for dispersing a colorant, such as a pigment. In this case, the particle size and the distribution thereof depend on the amount of the dispersing agent, the pressure and the number of dispersion passes. The colorant, such as a pigment, can also be dispersed in a liquid, for example, by using a ball mill and a sand mill. In this case, the, particle size and the distribution thereof depend on the dispersion time, the amount of the dispersing agent, and the material and the amount of the media;

The zeta potential used herein is measured in the following conditions. An electrophoresis light scattering photometer, LEZA600 (produced by Otsuka Electronics Co., Ltd.) is used under the following conditions. A sample is dispersed by ultrasonic dispersion in a 10 mM NaCl aqueous solution (0.01%), and after adjusting the pH of the sample with a 0.1 N HCl aqueous solution and a 0.1 N NaOH aqueous solution, the measurement is conducted at an applied voltage of 80 V.

The measurement of the particle diameter and the particle size distribution of the releasing agent, such as wax, and the colorant, such as a pigment, is conducted by the following manner. Microtrack UPA produced by NikkiSo Co., Ltd. is used, and the measurement is conducted using a 23° C. thermostat bath as a measurement temperature under such conditions that the measurement time is 300 seconds, the number of measurement is 1, the medium is water (refractive index: 1.33), and the signal level is from 0.65 to 0.75.

The indexes of particle size distribution that have been conventionally employed, ice., the volume GSDv and the number GSDp, may be simply used in the invention.

$$\text{Volume GSDv}=(D84v/D16v)^{1/2}$$

$$\text{Number GSDp}=(D84p/D16p)^{1/2}$$

In the equations, D84 represents a particle diameter providing an accumulation in particle size distribution of 84%, and v and p mean the volume particle size distribution and the number particle size distribution, respectively. D16 represents a particle diameter providing an accumulated in particle size distribution of 16%, and v and p mean the volume particle size distribution and the number particle size distribution, respectively. When the proportion of the coarse powder in the toner is large, it concerns deterioration of image quality and/or reliability. In the case of the production of a toner using the emulsion polymerization aggregation process, there is a tendency that a toner having a GSD of 1.30 or less (i.e., a good GSD) can be easily obtained. However, in the case where the volume particle proportion of particles of 16 μm or more is 5% or less, it may be difficult to manage by the GSD. Furthermore, in the, physicochemical production process, formation of coarse powder cannot be completely avoided due to the agitation failure and the adhered matters on a reaction vessel and an agitation blade. The coarse powder causes non-uniform gap formation in the transferring stop and scattering in a non-image area, and thus greatly concerns deterioration in image quality. Furthermore, it also causes toner scattering upon developing to bring about reduction in reliability due to contamination inside the apparatus. The problems becomes notable in the case of a spherical toner realizing high transfer efficiency since the coarse powder is liable to largely scatter in the vicinity of the image.

Therefore, in order to remove the coarse powder in the production of a toner using the emulsion polymerization aggregation process, it is effective to conduct filtration using a filter bag or mesh having an opening of 10 μm after formation of the particles, and it is also effective to conduct the filtration in multistage or repeatedly.

The influence of the proportion of the coarse powder on image quality Is increased as the toner has a smaller diameter or the shape of the toner approaches a spherical shape, Particularly, in the case where the toner has a diameter of 7 μm or less and the case where the toner has a shape factor SF1 shown by the following equation is from 100 to 130, it is preferred that the proportion of the coarse powder is decreased by the filter or mesh, $$SF1=(ML^2/A)\times(\pi/4)\times 100$$

wherein ML represents an absolute maximum length of the toner particles, and A represents a projected area of the toner particles.

These can be digitalized mainly by analyzing a micrograph or a transmission electron micrograph with an image analyzer.

The production progress of the toner by the emulsion polymerization aggregation process will be summarized below.

The process contains a step of preparing a rosin dispersion, for example, by emulsion polymerization, a stop of preparing, separate from the resin dispersion, a colorant dispersion having a colorant dispersed in a solvent, and depending on necessity, a step of preparing, separate from the resin dispersion and the colorant dispersion, a releasing agent dispersion having a releasing agent dispersed therein. The resin dispersion, the colorant dispersion and depending on necessity, the releasing agent dispersion thus obtained are then mixed to form mixed particles. Thereafter, the mixed particles are aggregated by adding an aggregating agent depending on necessity to form aggregated bodies, The aggregated bodies are then heated for fusing and unifying, so as to obtain the toner.

In general, the resin dispersion, the colorant dispersion and depending on necessity, the releasing agent dispersion are mixed at a time. Thus, the resulting aggregated bodies are in such a condition that two or three components are uniformly mixed. When the aggregated bodies are unified, the composition of the toner becomes uniform from the surface to the interior. Particularly, in the case where the releasing agent is contained, the releasing agent is present on the surface of the resulting toner due to the uniform mixing. Owing to the releasing agent present on the surface, filming may occur. Furthermore, an external additive added to impart fluidity is liable to be buried in the toner.

The inventors have found that while a combination of the mixing stop of the dispersions and the aggregate forming step is considered as one unit, or a combination of the mixing step, the aggregate forming step and the fusing and unifying step is considered as one unit, and the unit is repeated in plural times.

The step of repeating the unit in plural times will be specifically described below. For simplification, a first dispersion therein after referred. to as A1) containing first particles in a first concentration, a first dispersion (herein after referred to as A2) containing the first particles in a second concentration (different from the first concentration), a second dispersion (hereinafter referred to as B1) containing second particles in a first concentration, and a second dispersion (hereinafter referred to as B2) containing the second particles in a second concentration (different from the first concentration) are used.

Firstly, A1 and B1 are mixed (first mixing step), and the resulting. uniform mixture is aggregated to form aggregated body 11 (first aggregated, body forming step). The aggregated bodies 11 are used as mother aggregated particles, A2 and B2 arc mixed in a liquid having the mother aggregated particles dispersed therein (second mixing step). The mixture is further aggregated to form aggregated bodies 1122 (second aggregated body forming step). The thus resulting aggregated bodies 1122 is heated to conduct fusing and unifying, so as to obtain a toner.

The following process may also be employed. The aggregated bodies 11 are heated to conduct fusing and unifying (first fusing and unifying step) to obtain mother aggregated particles (11)'. A2 and B2 are mixed in a dispersion having the mother aggregated particles (11)' dispersed therein (second mixing step). The mixture is aggregated to form aggregated bodies (11)'22 (second, aggregated body forming step). The thus resulting aggregated bodies (11)'22 are heated to conduct fusing and unifying, so as to obtain a toner (second fusing and unifying step). By employing the first fusing and unifying step, the mother particles becomes nuclei, and with maintaining the composition and the property of the nuclei, fresh particles can be aggregated on the surface of the nuclei.

Furthermore, in the process where the unit it repeated in plural times, it is preferred that the amount and the balance of the aggregating agents ire changed between the first and second aggregated body forming steps. That is, the following manner can be employed. While the amount and the balance of the aggregating agents when the unit is conducted once are taken as a standard, the amount and the balance of the ionic surface active agents of the respective polarities are previously deviated from the standard in the first, aggregated body forming step. In the second aggregated body forming step, the surface active agents of such polarities and amount that compensate the deviation in the first step are added.

White the case where the unit is repeated twice is described in the foregoing, it can be easily expected by a skilled person in the art that the unit may be repeated three or more times. While the dispersions (A1, A2, B1 and B2) are used, which are dispersions having two kinds of particles in two kinds of concentrations, it can be easily expected by a skilled person in the art that the kinds of the particles can be increased to three or more, the concentrations is increased to three or more, and the kinds of the particles and the concentrations can be variously combined and used.

The composition and property of the toner particles can be changed stepwise from the interior to the surface by repeating the unit in plural times. Therefore, the structure of the toner can be controlled in an extremely convenient manner.

The process of repeating the unit in plural times can also be employed as a process for producing a color toner using a multi-color toner.

For example, in the case of a color toner using a multi-color toner, mother aggregated particles are produced by using a resin particle dispersion and a pigment particle dispersion in a first unit, and in a second unit, a toner is produced only by a resin particle dispersion, so as to form only a resin layer on the surface of the toner. The pigment particles are not exposed on the surface by using the procedure, and thus the influence of the pigment particles on the charging behavior can be minimized. Therefore, the charging characteristics can be controlled so as not to form differences depending on the kinds of the pigments. Furthermore, when the resin contained in the resin particle dispersion used in the second unit is selected to have a high glass transition point, the toner can be covered in a capsule form, whereby a thermal storage property can be established, and in combination with the effect described above, both the thermal storage property and the fixing property can be simultaneously realized.

When a toner is produced by using an inorganic particle dispersion in the second unit, the surface of the toner is covered with the inorganic particles to produce a structure encapsulated with the inorganic particles.

Furthermore, when fresh mother particles are formed by adding a releasing agent particle dispersion in the second units such as wax, and a shell is formed as the outermost surface by using a dispersion having a resin of high hardness or inorganic particles dispersed therein in the third unit, the structure of the toner can be controlled to have such a function that the exposure of the wax is suppressed but the wax effectively functions as a releasing agent upon fixing. It is also possible that the releasing agent particles are contained in the mother aggregated particles in the first unit, and in the second unit, the shell is formed on the outermost surface to suppress the exposure of the wax.

Examples of a polymer as the binder resin, particularly the thermoplastic binder resin, include a polymer of a monomer including a styrene compound, such as styrene, p-chlorostyrene and α-methylstyrene; an ester compound having a vinyl group, such as methyl acrylate, ethyl acrylate, n-propyl acrylate, lauryl acrylate, 2-ethylhexyl acryalte, methyl methacrylate, ethyl methacrylate, n-propyl methacrylate, lauryl methacrylate and 2-ethylhexyl methacrylate; a vinylnitrile compound, such as acrylonitrle and methacrylonitrile; a vinyl ether compound, such as vinyl methyl ether and vinyl isobutyl ether; a vinyl ketone compound, such as a vinyl methyl ketone, vinyl ethyl ketone and vinyl isopropenyl ketone; and a polyolefin compound, such as ethylene, propylene and butadiene, a copolymer obtain by combining two or more of the monomers, a mixture thereof, a non-vinyl fused resin, such as an epoxy resin, a polyester resin, a polyurethane resin, a polyamide resin, a cellulose resin and a polyether resin, a mixture of the non-vinyl fused resin and the vinyl series resin, and a graft polymer obtained by polymerizing the vinyl series monomer in the presence of the non-vinyl resin.

The resin particle dispersion can be formed from the vinyl series monomer by conducting emulsion polymerization or seed polymerization using an ionic surfactant. As for the other resins, when the resin is lipophilic and can be dissolved in a solvent having a relatively low solubility in water, it is preferred that the resin is dissolved in the solvent, and an ionic surfactant and/or a polymeric electrolyte are dissolved in water, both of which are subjected to a disperser, such as a homogenizer, to disperse fine particles in water. Thereafter, the solvent is evaporated by heating or reducing the pressure to prepare the resin dispersion.

As examples or the dissociative vinyl series monomer, a monomer becoming a raw material of a polymeric acid or a polymeric base, such as acrylic acid, methaerylic acid, maleic acid, cinnamic acid, fumaric acid, vinylsulfonic acid, othyleneimine, vinylpyridine and vinylamine, can be used. A polymeric acid is preferred from the, standpoint of easiness of the polymer forming reaction, and a dissociative vinyl series monomer having a carboxyl group, such as acrylic acid, methacrylic acid, raloic acid, cinnamic acid and fumarc acid, is preferred for controlling the polymerization degree and the grass transition point.

Examples of the releasing agent include a low molecular weight polyolefin, such as polyethylene, polypropylene and polybutene; a silicone having a softening point by heating; a fatty acid amide, such as olein acid amide, erucic amide, recinoleic amide and stearic amide; vegetable wax, such as ester wax, carnauba wax, rice wax, candelilla wax, wood wax and jojoba oil; animal wax, such as bees wax; mineral or petroleum wax, such as montan wax, ozokerite, ceresin, paraffin wax, microcrystalline wax and Fischer-Tropsch wax, and a modification product thereof.

The releasing agent, such as wax, is dispersed in water along with an ionic surfactant and a polymeric electrolyte, such as a polymeric acid and a polymeric base. Thereafter, it is heated to a temperature higher than the melting point of the releasing agent and is formed into fine particles by a homogenizer or a pressure discharge disperser having a function of applying a strong sharing force, so as to prepare a dispersion of particles having a diameter of 1 μm or less.

Examples of the colorant and an internal additive that can be contained along with the colorant include various pigments, such as carbon black, chrome yellow, Hansa Yellow, Benzidine Yellow, Suren Yellow, Quinoline Yellow, Permanent Orange GTR, Pyrazolone Orange, Vulcan Orange, Watchung Red, Permanent Red, Brilliant Carmine 3B, Brilliant Carmine 6B, Du Pont Oil Red, Pyrazolone Red, Lithol Red, Rhodamine B Lake, Lake Red C, Rose Bengal, Aniline Blue, Ultramarine Blue, Carcoil Blue, Methylene Blue Chloride, Phthalocyanine Blue, Phthalocyanine Green and Malachite Green Oxalate; and varous dyes, such as acridine series, xanthenae series, azo series, benzoquinone series, azine series, anthraquinone series, thioindigo series, dioxane series, thiazine series, azomethine series, indigo series, thioindigo series, phthalocyanine series, aniline black series, polymethine series, triphenylmethane series, diphenylmethane series, thiazinu series, thiazole series and xanthene series. The colorant may be used singly or in combination of plural kinds.

Furthermore, a magnetic body can be used as an internal additive, examples of which include a metal, an alloy and a compound containing a metal, such as ferrite, magnetite, reduced iron, cobalt, nickel and manganese. Various charge controlling agents may also be used, examples, of which, include a dye containing a complex, such as a quaternary ammonium salt compound, a nigrosine compound, aluminum, iron and chromium, and a triphenylmethane series pigment. The internal additive is preferably the one is difficult to be dissolved in water from the standpoint of control of ion intensity, which influences the stability on aggregation and fusion, and reduction in pollution due to waste water.

Examples of the inorganic particles include any particles that are generally used as an external additive on the surface of a toner, such as silica, alumina, titania, calcium carbonate, magnesium carbonate and tricalcium phosphate. The dispersion of inorganic particles can be prepared by dispersing them with an ionic surfactant, a polymeric acid or a polymeric base. The dispersion can be used in the production process of a toner using the emulsion polymerization aggregation process.

As similar to tie ordinary toners, inorganic particles, such as silica, alumina, titania and calcium carbonate, and fine resin particles, such as a vinyl series resin, polyester and silicone, may be added to the surface of the resulting toner particles after drying by applying a sharing force, so as to use as a fluidizing aid or a cleaning aid.

A surface active agent may be used in the emulsion polymerization or seed polymerization for forming the resin particles; dispersion of the resin particles, the colorant, such as a pigment, and the releasing agent; aggregation of the mixed particles; and stabilization of the aggregated bodies. Examples of the surfactant include an anionic surfactant, such as sulfate series, sulfonate series, phosphate series and soap series; and a cationic surfactant, such as an amine salt type and a quaternary ammonium salt type. It is effective to use the surfactants described in the foregoing in combination with a nonionic surfactant, such as polyethylene glycol series, alkylphenol ethyleneoxide adduct series and polyvalent alcohol series.

As an apparatus for dispersing, ordinary ones, such as a rotation sharing type homogenizer and a ball mill a sand mill and a Dyno-mill containing a medium, can be employed.

In the case where a composite body containing a resin and a pigment is used, a method where after dissolving and dispersing a resin and a pigment in a solvent, they are dispersed in water with the suitable dispersing agent described in the foregoing, and the solvent is removed by heating or reducing the pressure may be employed, and it is also possible that they are adsorbed and fixed on the surface of a latex formed by emulsion polymerization or seed polymerization by mechanical sharing or an electric manner.

These methods are effective for suppressing isolation of the pigment as additional particles and for improving the pigment dependency of the charging characteristics,

EXAMPLE 1

The following composition is weighed and preliminary mixed, and then mixed and coarsely pulverized by a Banbury mixer (produced by Kobe Steel, Ltd.). Thereafter, it is pulverized by a jet mill and subjected to classification once in the coarse powder side and twice in the fine powder side using a small-sized elbow jet, so as to obtain a black toner X-1 having an average particle diameter of 6.8 $\mu$m, a volume GSD of 1.24 and a GSDpS of 1.27. The toner X-1 had a shape factor SF1 of 145, The toner X-1 has a surface property index of 3.22.

| | |
|---|---|
| Polyester resin<br>(Bisphenol A-fumaric acid-propylene oxide series)<br>(Prototype produced by Kao Corp., Mw: $3.2 \times 10^4$, Mn: $0.7 \times 10^4$, glass transition point: 57° C.) | 87 parts by weight |
| Carbon black<br>(Regal 330 produced by Cabot Corporation) | 5 parts by weight |
| Hiwax 200P<br>(polyethylene wax produced by Mitsui Chemical Co., Ltd.) | 8 parts by weight |

0.8% by weight of Silica TS720 produced by Cabot Corporation is externally added to the toner X-1 to obtain a toner (X-1)'. The toner (X-1)' and a carrier are mixed to have a toner concentration of 8% by weight to prepare a developer Z-1. The carrier used herein is obtained by coating polymethyl methacrylate (produced by Soken Chemical Co., Ltd.) in an amount of 1% by weight on a ferrite core having an average particle diameter of 50 $\mu$m. Evaluation of image quality is conducted by using the resulting developer Z-1 and a modified machine of V500 (produced by Fuji Xerox Co., Ltd.).

Exaluation

The evaluation of image quality employed herein will be briefly described below.

(1) Uniformity of Solid Image

An image of an area ratio of 10% is output for 100,000 sheets by the V500 modified machine using J Coat paper produced by Fuji Xerox Co., Ltd. as a final transfer material under an environment where the developer has a temperature of 22° C. and a humidity of 55%. The uniformity of a solid area of a solid image after 100,000 sheets output is evaluated for the following. grades.

A: Unevenness in density is not found.

B: Slight unevenness in density is observed.

C: Apparent unevenness in density is observed.

(2) Evaluation of Image Quality Characteristics

The image is output for 100,000 sheets under the same environment as in (1), and the image quality after 100,000 sheets output is evaluated. The evaluation is conducted under the following conditions, (i) reproducibility of thin lines and (II) background fogging.

(2)-(i) Reproducibility of Thin Lines

An image of thin lines is formed on a photoreceptor to have a line width of 50 $\mu$m, which is then transferred and fixed. An image of thin lines as a fixed image on a transfer material is observed at a magnification of 175 times by using VH-6200 Micro Hiscope (produced by Keyeace Corp.). Specific evaluation grades are shown below, and the grade A is allowable.

A: The thin lines are uniformly filled with the toner with no correlation on the edge part.

B: The thin lines are uniformly filled with the toner, but correlation is, conspicuous on the edge part.

C: The thin lines are not uniformly filled with the toner, and correlation is very conspicuous on the edge part.

(2)-(ii) Background Fogging

The extent of scattering of the toner on a non-image part is observed. Specific evaluation grades are shown below, and the grade A is allowable.

A: Fogging is not observed by naked eye,

B: Slight fogging is observed by naked eye.

C: Conspicuous fogging is observed.

(3) Transfer Efficiency

When an image is transferred from a photoreceptor to paper, the transfer efficiency is evaluated by a value obtained from the amount of the toner remaining on the photoreceptor and the amount of toner on the paper according to the following equation.

Transfer efficiency (%)={Toner amount on paper/(Toner amount on paper+Toner amount remaining on Photoreceptor)}×100

(4) Continuous Duplication Test

A continuous duplication test of 100,000 sheets Is conducted on the V500 modified machine. Specifically, an image of an image ratio of 10% is continuously duplicated under an environment of 22° C. and 55% RH. Specific evaluation grades are shown below, and the grade A is allowable.

A: No image quality deterioration occurs after 100,000 sheets.

B: Image quality deterioration occurs 80,000 sheets or more and less than 100,000 sheets.

C: Image quality deterioration occurs 50,000 sheets or more and less than 80,000 sheets.

D: Image quality deterioration occurs 30,000 shoots or more and less than 50,000 sheets.

E: Image quality deterioration occurs 30,000 sheets or less.

As a result of the evaluations, Example 1 using the developer Z-1 exhibits a slightly low transfer efficiency (87.5%) but forms a clear image, in which a solid image is well filled without correlation in reproduction of thin lines or fogging, aid thus an image of a usable level is obtained.

EXAMPLE 2

Preparation of Resin Dispersion A-1:913

The following composition is mixed and dissolved.

| | |
|---|---|
| Styrene | 300 g |
| n-Butyl acrylate | 100 g |
| Acrylic acid | 8 g |
| Dodecanethiol | 3 g |

The resulting solution is dispersed and emulsified in 250 g of ion exchanged water having 3 g of a nonionic surfactant Nonipole 400 (produced by Sanyo Chemical Industries, Ltd.) and 5 g of an anonic surfactant Noogen SC (produced by Dai-ichi Kogyo Seiyaku Co., Ltd.) dissolved therein in a flask, so as to prepare a monomer emulsion. Separately, 3 g of Nonipole 400 and 5 g of Neogen SC are dissolved in 300 g of ion exchanged water, and nitrogen substitution of the resulting surfactant aqueous solution is conducted under slowly stirring over 10 minutes. Thereafter, the temperature of the surfactant aqueous solution is increased to 75° C., and 5.0% of the monomer emulsion is added dropwise into the surfactant aqueous solution. 50 g of ion exchanged water having 4 g of ammonium persulfate dissolved therein is put into the reaction mixture, and then another 50% of the monomer emulsion is added dropwise thereto over 1 hour, The content of the flask is maintained at 75° C. over an oil bath under stirring to continue emulsion polymerization for 4 hours.

As a result of the procedure, an anionic resin dispersion A-1 having a volume average particle diameter of 200 nm, a glass transition point of 53.5° C., a weight average molecular weight Mw of 47,000 and a number average molecular weight Mn of 12,500 is obtained. The measurement of the zeta potential of the dispersion reveals −55 mV at pH 2.5.

Preparation of Pigment Dispersion B-1:

The following composition is mixed and dissolved, and the mixture is dispersed by a homogenizer (IKA Ultra-Turrax) at irradiation of ultrasonic wave, so as to obtain a bile pigment dispersion B-1 having a volume average particle diameter of 150 nn.

| | |
|---|---|
| Cyan pigment (C.I.Pigment Blue 15:3) (Copper phthalocyanine produced by Dainippon Ink and Chemicals Inc.) | 50 g |
| Anionic surfactant Neogen SC | 5 g |
| Ion exchanged water | 200 g |

Preparation of Releasing Agent Dispersion C-1

The following composition is mixed and heated to 97° C., and the mixture is dispersed by a homogenizer Ultra-Turrax T50 produced by IKA Works, Inc. Thereafter, it is subjected to a dispersion treatment by a Gaulin homogenizer 20 times under conditions of 105° C. and 550 kg/cm$^2$, so as to obtain a wax dispersion C-1 having a volume average particle diameter of 190 nm, GSDpS of 1.8 and GSDpL of 1.5.

| | |
|---|---|
| Polywax 725 (Polyethylene wax produced by Toyo Petrolite Co., Ltd.) | 50 g |
| Anionic surfactant Neogen SC | 5 g |
| Ion exchanged water | 200 g |

Preparation of Aggreted Toner X-2:

The following composition is mixed and dispersed in a round bottom stainless steel flask by Ultra-Turrax T50, and then the content of the flask is heated to 48° C. over an oil bath for heating under stirring, and maintained at 48° C. for 30 minutes.

| | |
|---|---|
| Resin dispersion A-1 | 200 g |
| Pigment dispersion B-1 | 30 g |
| Releasing agent dispersion C-1 (corresponding to about 8%) | 40 g |
| 10 wt% aqueous solution of polyaluminum chloride (produced by Asada Chemical Industries, Ltd.) | 1.5 g |

Thereafter, the resulting content is observed by an optical microscope, and it is confirmed that aggregated particles of about 4.5 μm are formed. 100 g of the resin dispersion A-1 is further gradually added thereto, and the temperature is increased to 50° C. by increasing the temperature of the oil-bath for heating, and maintained at 50° C. for 1 hour. The resulting content is observed by an optical microscope, and it is confirmed that aggregated particles of about 5.5 μm are formed.

Then, after adding 15 g of 1N sodium hydroxide thereto, the stainless steel flask is sealed and heated to 85° C. under continuous stirring using a magnetic seal, which is maintained for 4 hours. After cooling, the content is filtered and sufficiently washed with ion exchanged water, it is dried to obtain aggregated toner particles X-2. The measurement of the particle diameter of the aggregated toner particles X-2 by a Coulter counter reveals 55 μm. It has a volume GSD as an index of volume particle size distribution of 1.20, GSDpS of 1.25 and a shape factor SF1 of 115, which means that the particles are substantially spherical. The aggregated toner particles X-2 has a surface, property index of 1.56.

1.2% by weight of Silica TS720 produced by Cabot Corporation is externally added to the aggregated toner particles X-2 in the same manner as in Example 1 to obtain a toner (X-2)'.

The toner (X-2)' and a carrier are mixed to have a toner concentration of 8% by weight to prepare a developer Z-2. The carrier used herein it obtained by coating polymethyl methacrylate (produced by Solken Chemical Co., Ltd.) in an amount of 1% by weight on a ferrite core having an average particle diameter of 50 μm. Evaluation of image quality is conducted by using the resulting developer Z-2 and the V500 modified machine in the same manner as in Example 1.

As a result of the evaluation of image quality, when the developer Z-2 of Example 2 is used, a clear image exhibiting accurate reproducibility of thin lines is obtained that is completely free of fogging. The measurement of the transfer efficiency reveals a high value of 99.2%. No deterioration in image quality is observed even after the continuous duplication test for 100,000 sheets.

COMPARATIVE EXAMPLE 1

Preparation of Resin Dispersion A-2:

The following composition is mixed and dissolved.

| | |
|---|---|
| Styrene | 300 g |
| n-Butyl acrylate | 100 g |
| Acrylic acid | 9 g |
| Dodecanethiol | 3 g |

The resulting solution is dispersed and emulsified in 250 g of ion exchanged water having 5 g of a nonionic surfactant Nonipole 400 (produced by Sanyo Chemical Industries, Ltd.) and 5 g of an anionic surfactant Neogen SC (produced by Dai-ichi Xogyo Seiyaku Co., Ltd.) dissolved therein in a flask, so as to prepare a monomer emulsion. Separately, 5 g of Nonipole 400 and 5 g of Neogen SC arc dissolved in 300 g of ion exchanged water, and nitrogen substitution of the resulting surfactant aqueous solution is conducted under slowly stirring over 10 minutes. Thereafter, the temperature of the surfactant aqueous solution is increased to 75° C., and 50% of the monomer emulsion is added dropwise into the surfactant aqueous solution, 50 g of ion exchanged water having 3 g of ammonium persulfate dissolved therein is put into the reaction mixture, and then another 50% of the monomer emulsion is added dropwise thereto over 1 hour. The content of the flask is maintained at 75° C. over an oil bath under stirring to continue emulsion polymerization for 4 hours.

As a result of the procedure, an anionic resin dispersion A-2 having a volume average particle diameter of 140 nm, a glass transition point of 53.0° C. a weight average molecular weight Mw of 55,000 and a number average molecular weight Mn of 16,000 is obtained. The measurement of the zeta potential of the dispersion reveals −46 mV at pH 2.5.

Aggregated toner particles X-3 are prepared in the same manner as in Example 2 except that the resin dispersion A-1 is changed to the resin dispersion A-2. During the preparation, particles obtained before and after the addition of 100 g of the resin dispersion A-2 are observed with in optical microscope, and it is confirmed that particles of about 4.0 μm are formed before the addition, and particles of about 5.2 μm are formed after the addition.

The particle diameter of the aggregated toner particles X-3 finally obtained measured by a Coulter counter is 5.4 μm. It has a volume GSD as an index of volume particle size distribution of 1.25, GSDpS of 1.28 and a shape factor SF1 of 119, which means that the particles are substantially spherical. The aggregated toner particles X-3 has a surface property index of 2.20.

1.2% by weight of Silica TS720 produced by Cabot Corporation is externally added to the aggregated toner particles X-3 in the same manner as in Example 2 to obtain a toner (X-3)'.

The toner (X-3)'0 and the carrier used in Example 2 are mixed to have a toner concentration of 8% by weight to prepare a developer Z-3. Evaluation of image quality is conducted by using the resulting developer Z-3 and the V500 modified machine in the same manner as in Example 1.

As a result of the evaluation of image quality, when the developer Z-3 of Comparative Example 1 is used, an image exhibiting accurate reproducibility of thin lines that is completely free of fogging is obtained although it is slightly inferior to the results of the developer Z-2 of Example 2. However, slight non-uniformity is observed in finding a solid image. The measurement of the transfer efficiency reveals 95.2%, which is i considerably, low value in comparison to Example 2. The continuous duplication test is conducted but is terminated at 80,000 sheets duplication, at which formation of fogging is observed.

EXAMPLE 3

Preparation of Resin Dispersion A-3:

The following composition is mixed and dissolved.

| | |
|---|---|
| Styrene | 290 g |
| n-Butyl acrylate | 110 g |
| Acrylic acid | 10 g |
| Dodecanethiol | 4 g |
| Divinylbenzene | 0.4 g |

The resulting solution is dispersed and emulsified in 250 g of ion exchanged water having 3 g of a nonionic surfactant Nonipole 400 (produced by Sanyo Chemical Industries, Ltd.) and 5 g of an anionic surfactant Neogen SC (produced by Dai-ichi Kogyo Seiyaku Co., Ltd.) dissolved therein in a flask, so as to prepare a monomer emulsion. Separately, 3 g of Nonipole 400 and 5 g of Neogen SC are dissolved in 300 g of ion exchanged water, and nitrogen substitution of the resulting surfactant aqueous solution is conducted under slowly stirring over 10 minutes. Thereafter, the temperature of the surfactant aqueous solution is increased to 75° C., and 30% of the monomer emulsion is added dropwise into the surfactant aqueous solution, 50 g of ion exchanged water having 5 g of ammonium persulfate dissolved therein is put into the reaction mixture and then another 70% of the monomer emulsion is added dropwise thereto over 1 hour and 30 minutes. The content of the flask in maintained at 75° C. over an oil bath under stirring to continue emulsion polymerization for 4 hours.

As a result of the procedure, an anionic resin dispersion A-2 having a volume average particle diameter of 180 nm, a glass transition point of 52.0° C., a weight average molecular weight Mw of 39,000 and a number average molecular Weight Mn of 10,500 is obtained. The measurement of the zeta potential of the dispersion A-3 reveals −66 mV at pH 2.5.

Preparation of Pigment Dispersion B-2:

A carbon dispersion B-2 having a volume average particle diameter of 100 nm is obtained in the same manner as in the preparation of the dispersion B-1 except that the cyan pigment in the preparation of the pigment dispersion B-1 is changed to carbon black R330 (produced by Cabot Corporation).

Preparation if Releasing Agent Dispersion C-2:

A wax dispersion C-2 having a volume average particle diameter of 160 nm, GSDvS of 1.9 and GSDvL of 18 is obtained in the same manner as in the preparation, of the dispersion C-1 except that Polywax 725 (polyethylene wax produced by Toyo Petrolite Co., Ltd.) is changed to FP1000 (Fischer-Tropach wax produced by Nippon Seiro Co., Ltd.).

Preparation of Aggregated Toner X-4:

The following composition is mixed and dispersed in a round bottom stainless steel flask by Ultra-Turrax T50, and then the content of the flask is heated to 50° C. over an oil bath for heating under stirring, and maintained at 50° C., for 30 minutes.

| | |
|---|---|
| Resin dispersion A-3 | 200 g |
| Pigment dispersion B-2 | 30 g |
| Releasing agent dispersion C-2 (corresponding to about 6%) | 30 g |
| 10 wt% aqueous solution of polyaluminum chloride (produced by Asada Chemical Industries, Ltd.) | 1.5 g |

Thereafter, the resulting content is observed by an optical microscope, and it is confirmed that aggregated particles of about 5.2 μm are formed. 100 g of the resin dispersion A-3 is further gradually added thereto, and the a temperature is increased to 52° C. by increasing the temperature of the oil bath for heating, and maintained at 52° C. for 1 hour. The resulting content is observed by an optical microscope, and it is confirmed that aggregated particles of about 6.0 μm are formed.

Then, after adding 15 g of 1N sodium hydroxide thereto, the stainless steel flask is sealed and heated to 85° C. under continuous stirring using a magnetic seal, which is maintained for 4 hours. After cooling, the content is. filtered and sufficiently washed with ion exchanged water, it is dried to obtain aggregated toner particles X-4. The measurement of the particle diameter of the aggregated toner particles X-4 by a Coulter counter reveals 6.0 μm. It has a volume GSD as an index of volume particle size distribution of 1.17, GSDpS of 1.22, which indicates an extremely narrow particle size distribution and a shape factor SF1 of 118, which means that the particles are substantially spherical. The aggregated toner particles X-4 has a surface property index of 1.50.

1.2% by weight of Silica TS720 produced by Cabot Corporation is externally added to the aggregated toner particles X-4 in the same manner as in Example 1 to obtain a toner (X-4)'.

The toner (X-4)' and the carrier used in Example 1 are mixed to have a toner concentration of 8% by weight to prepare a developer Z-4. Evaluation of image quality is conducted by using the resulting developer Z-4 and the V500 modified machine in the same manner as in Example 1.

As a result of the evaluation of image quality, when the developer Z-4 of Example 3 is used, a clear image exhibiting accurate reproducibility of thin lines that is completely free of fogging is obtained. The measurement of the transfer efficiency reveals a high value of 99.9%. No deterioration in image quality is observed even after the continuous duplication test for 100,000 sheets.

COMPARATIVE EXAMPLE 2

Preparation of Pigment Dispersion B-3

The same composition as the pigment dispersion B-2 is use, provided that the resulting carbon dispersion B-3 contains carbon black particles having a volume average particle diameter of 260 nm.

Preparation of Aggregated Toner Particles X-5:

Aggregated toner particles X-5 are prepared in the same manner as in the preparation of the aggregated toner particles X-4 in Example 3 except that, the pigment dispersion B-2 is chanted to the pigment dispension B-3. The particle diameter of the resulting aggregated toner particles X-4 measured by a Coulter counter is 6.0 μm. It has a volume GSD as an index of volume particle size distribution of 1.24, GSDpS of 1.29, which indicates a slightly broadened particle size distribution on the fine powder side, and a shape factor SF1 of 116, which means that the particles are substantially spherical. The aggregated toner particles X-5 has a surface property index of 2.65.

1.2% by weight of Silica TS720 produced by Cabot Corporation is externally added to the aggregated toner particles X-5 in the same manner as in Example 1 to obtain a toner (X-5)'.

The toner (X-5)' and the carrier used in Example 1 are mixed to have a toner concentration of 8% by weight to prepare a developer Z-5. Evaluation of image quality is conducted by using the resulting developer Z-5 and the V500 modified machine in the same manner as in Example 1.

As a result of the evaluation of image quality, when the developer Z-5 of Comparative Example 2 is used, an image exhibiting interrupted reproduction of thin lines with some fogging is obtained. The measurement of the transfer efficiency reveals a slightly low value of 94.4%. The continuous duplication test is conducted but is terminated at 50,000 sheets duplication, at which increased formation of fogging is observed.

COMPARATIVE EXAMPLE 3

Preparation of Releasing Agent Dispersion C-3:

The following composition is mixed and heated to 97° C., and the mixture is dispersed by a homogenizer Ultra-Turrax T50 produced by IKA Works, Inc. Thereafter, it is subjected to a dispersion treatment by a Gaulin homogenizer 5 times under conditions of 98° C. and 350 kg/cm$^2$, so as to obtain a wax dispersion C-3 having a volume average particle diameter of 310 nm, GSDpS of 2.2 and GSDpL of 2.1.

| | |
|---|---|
| FP100 (Fischer-Tropsch wax produced by Nippon Seiro Co., Ltd.) | 50 g |
| Anionic surfactant Neogen SC | 5 g |
| Ion exchanged water | 200 g |

Preparation of Aggregated Toner Particles X-6:

Aggregated toner particles X-6 are prepared in the same manner as in the preparation of the aggregated toner particles X-4 in Example 3 except that the releasing agent dispersion C-2 is changed to the releasing agent dispersion C-3. During the preparation, particles obtained before and after the addition of 100 g of the resin dispersion A-3 are observed with an optical microscope, and it is confirmed that particles of about 5.5 μm are formed before the addition, and particles of about 6.2 μm are formed after the addition.

The particle diameter of the aggregated toner particles X-6 finally obtained measured by a Coulter counter is 6.2 μm. It has a volume GSD as an index of volume particle size distribution of 1.25, GSDpS of 1.32, which indicates a slightly broadened particle size distribution an the fine powder side, and a shape factor SF1 of 120, which means that the particles are substantially spherical. The aggregated toner particles X-6 has a surface property index of 2.88.

1.2% by weight of Silica TS720 produced by Cabot Corporation is externally added to the aggregated toner particles X-6 in the same manner as in Example 1 to obtain a toner (X-6)'.

The toner (X-6)' and the carrier used in Example 1 are mixed to have a toner concentration of 8% by weight to prepare a developer Z-6. Evaluation of image quality is conducted by using the resulting developer Z-6 and the V500 modified machine in the same manner as in Example 1.

As a result of the evaluation of image quality, when the developer Z-6 of Comparative Example 3 is used, an image exhibiting slightly interrupted reproduction of thin lines with insufficient filling in a solid image and some extent of fogging is obtained. The measurement of the transfer efficiency reveals 93.5%, which is a considerably low value as one using a spherical toner. The continuous duplication test is conducted but is terminated at 45,000 sheets duplication, at which the extent of fogging is increased.

EXAMPLE 4

Preparation of Resin Dispersion A-4:

The following composition is mixed and dissolved.

| | |
|---|---|
| Styrene | 320 g |
| n-Butyl acrylate | 80 g |
| Acrylic acid | 10 g |
| Dodecanethiol | 5 g |

The resulting solution is dispersed and emulsified in 250 g of ion exchanged water having 3 g of a nonionic surfactant Nonipole 400 (produced by Sanyo Chemical Industries, Ltd.) and 5 g of an anionic surfactant Neogen SC (produced by Dai-ichi Kogyo Seiyaku Co., Ltd.) dissolved therein in a flask, so as to prepare a monomer emulsion. Separately, 3 g of Nonipole 400 and 5 g of Neogen SC are dissolved in 300 g of ion exchanged water, and nitrogen substitution of the resulting surfactant aqueous solution is conducted under slowly stirring over 10 minutes. Thereafter, the temperature of the surfactant aqueous solution is increased to 75° C., and 50% of the monomer emulsion is added dropwise into the surfactant aqueous solution. 50 g of ion exchanged water having 4 g of ammonium persulfate dissolved therein is put into the reaction mixture, and then another 50% of the monomer emulsion is added dropwise thereto over 1 hour. The content of the flask is maintained at 75° C. over an oil bath under stirring to continue emulsion polymerization for 4 hours.

As a result of the procedure, an anionic resin dispersion A-4 having a volume average particle diameter of 240 nm, a glass transition point of 55.2° C., a weight average molecular weight Mw of 32,000 and a number average molecular weight Mn of 10,200 is obtained. The measurement of the zeta potential of the dispersion reveals −71 mV at pH 2.5.

Preparation of Pigment Dispersion B-4:

The following composition is mixed and dissolved, and the mixture is dispersed by a ball mill (1L scale glass balls, volume ratio: 35%) for 10 hours, so as to obtain a magenta pigment dispersion B-4 having a volume average particle diameter of 120 nm.

| | |
|---|---|
| Magenta pigment R122 (Dimethyl quinacridone produced by Dainippon Ink and Chemicals Inc.) | 50 g |
| Anionic surfactant Neogen SC | 5 g |
| Ion exchanged water | 200 g |

Preparation of Releasing Agent Dispersion C-4:

The following composition is mixed and heated to 110° C., and the mixture is dispersed by a homogenizer Ultra-Turrax T50 produced by IKA Works, Inc. Thereafter, it is subjected to a dispersion treatment by a Gorlin homogenizer (produced by Meiwa Shoji Co., Ltd.) 20 times under conditions of 120° C. and 550 kg/cm$^2$, so as to obtain a wax dispersion C-4 having a volume average particle diameter of 210 nm, GSDvS of 1.5 and GSDvL of 1.7.

| | |
|---|---|
| Hiwax 100P (polyethylene wax produced by Mitsui Chemical Co., Ltd.) | 50 g |
| Anionic surfactant Neogen SC | 5 g |
| Ion exchanged water | 200 g |

Preparation of Aggregated Toner X-7:

The following composition is mixed and dispersed in a round bottom stainless steel flask by ultra-Turrax T50, and then the content of the flask is heated to 50° C. over an oil bath for heating under stirring, and maintained at 50° C. for 30 minutes.

| | |
|---|---|
| Resin dispersion A-4 | 200 g |
| Pigment dispersion B-4 | 30 g |
| Releasing agent dispersion C-4 (corresponding to about 8%) | 40 g |
| 10 wt % aqueous solution of polyaluminum chloride (produced by Asada Chemical Industries, Ltd.) | 1.5 g |

Thereafter, the resulting content is observed by an optical microscope, and it is confirmed that aggregated particles of about 4.8 μm are formed, 100 g of the resin dispersion A-4 is further gradually added thereto, and the temperature is increased to 52° C. by increasing the temperature of the oil bath for heating, and maintained at 52° C. for 1 hour. The resulting content, is observed by an optical microscope, and it is confirmed that aggregated particles of about 5.8 μm are formed.

Then, after adding 15 g of 1N sodium hydroxide thereto, the stainless steel flask is sealed and heated to 85° C. under continuous stirring using a magnetic teal, which is maintained for 4 hours. After cooling, the content is filtered and sufficiently washed with ion exchanged water, it is dried to obtain aggregated toner particles X-7. The measurement of the particle diameter of the aggregated toner particles X-7 by a Coulter counter reveals 5.9 μm. It has a volume GSD as an index of volume particle size distribution of 1.18, GSDpS of 1.26 and a shape factor SF1 of 118, which means that the particles are substantially spherical. The aggregated toner particle or, X-7 has a surface property index of 1.80.

1.2% by weight of Silica TS720. produced by Cabot Corporation is externally added to the aggregated toner particles X-7 in the same manner as in Example 1 to obtain a toner (X-7)'.

The toner (X7)' and the carrier used in Example 1 are mixed to have a toner concentration of 3% by weight to prepare a developer Z-7. Evaluation of image quality is conducted by using the resulting developer Z-7. and the V500 modified machine in the same, manner as in Example 1.

As a result of the evaluation of image quality, when the developer Z-7 of Example 4 is used, a clear image exhibiting accurate reproducibility of thin lines that is completely free of fogging is obtained. The measurement of the transfer efficiency reveals a high value of 99.9%. No deterioration in image quality is observed even after the continuous duplication test for 100,000 sheets.

COMPARATIVE EXAMPLE 4

Preparation of Pigment Dispersion B-5:

The following composition is mixed and dissolved, and the mixture i&, dispersed by a ball mill (1L scale glass balls, volume ratio: 45%) for 30 hours, so as to obtain a magenta pigment dispersion B-5 having a volume average particle diameter of 65 nm.

| | |
|---|---|
| Magenta pigment R122 (Dimethyl quinacridone produced by Dainippon Ink and Chemicals Inc.) | 50 g |
| Anionic surfactant Neogen SC | 5 g |
| Ion exchanged water | 200 g |

Preparation of Aggregated Toner Particles X-8:

Aggregated toner particles X-8 are prepared in the same manner as in the preparation of the aggregated toner particles X-7 in Example 4 except that the pigment dispersion B-4 is changed to the pigment dispersion B-5. During the preparation, particles obtained before and after the addition of 100 g of the resin dispersion A-4 are observed with an optical microscope, and it is confirmed that particles of about 5.0 μm are formed before the addition, and particles of about 6.0 μm are formed after the addition.

The particle diameter of the aggregated toner particles X-8 finally obtained measured by a Coulter counter is 6.0 μm. It has a volume GSD as an index of volume particle size distribution of 1.22 and GSDpS of 1.28. The shape factor SF1 is 130, which means a potato-like shape greatly deviating from a spherical form. Observation with an electron microscope indicates that great unevenness is found on the surface. The aggregated toner particles X-8 has a surface property index of 3.35.

1.2% by weight of Silica TS720 produced by Cabot Corporation is externally added to the aggregated toner particles X-8 in the same manner as; in Example 1 to obtain a toner (X-8)'.

The toner (X-8)' and the carrier used in Example 1 are mixed to have a toner concentration of 8% by weight to prepare a developer Z-8. Evaluation of image quality is conducted by using the resulting developer Z-8 and the V500 modified machine in the same manner as in. Example 1.

As a result of the evaluation of image quality, when the developer Z-8 of Comparative Example 4 is used, an image exhibiting slightly interrupted reproduction of thin lines with insufficient filling in a solid image and some extent of fogging is obtained. The measurement of the transfer efficiency reveals 90.5%, which is a considerably low value owing to the toner shape. The continuous duplication test is conducted but is terminated at 25,000 sheets duplication, at which the extent of fogging is increased.

For reference, the characteristics of the particles used in Examples 1 to 4 and Comparative Examples 1 to 4 and the results of evaluation of image quality are shown in Table 1 below.

TABLE 1

| Production process | Example 1 Pulverization process | Example 2 Aggregation process | Comparative Example 1 Aggregation process | Example 3 Aggregation process | Comparative Example 2 Aggregation process | Comparative Example 3 Aggregation process | Example 4 Aggregation process | Comparative Example 4 Aggregation process |
|---|---|---|---|---|---|---|---|---|
| Zeta potential of resin particles mV | — | −55 | −46 | −66 | −66 | −66 | −71 | −71 |
| Volume average particle diameter of releasing agent nm | — | 190 | 190 | 160 | 160 | 310 | 210 | 210 |
| Releasing agent GSDvS | — | 1.8 | 1.8 | 1.9 | 1.9 | 2.2 | 1.5 | 1.5 |
| Releasing agent GSDvL | — | 1.5 | 1.5 | 1.8 | 1.8 | 2.1 | 1.7 | 1.7 |
| Volume average particle diameter of pigment mm | — | 150 | 150 | 100 | 260 | 100 | 120 | 65 |
| Average particle diameter of toner μm | 6.8 | 5.5 | 5.4 | 6.0 | 6.0 | 6.2 | 5.9 | 6.0 |
| Volume GSD | 1.24 | 1.20 | 1.25 | 1.17 | 1.24 | 1.25 | 1.18 | 1.22 |
| GSDpS | 1.27 | 1.25 | 1.28 | 1.22 | 1.29 | 1.32 | 1.26 | 1.28 |
| Shape factor SF1 | 145 | 115 | 119 | 118 | 116 | 120 | 118 | 130 |
| Surface property index | 3.22 | 1.56 | 2.20 | 1.50 | 2.65 | 2.88 | 1.80 | 3.35 |
| Uniformity of solid image | A | A | C | A | C | C | A | B |
| Reproducibilty of thin lines | A | A | B | A | C | C | A | C |
| Background fogging | A | A | B | A | C | C | A | B |

TABLE 1-continued

| Production process | Example 1 Pulverization process | Example 2 Aggregation process | Comparative Example 1 Aggregation process | Example 3 Aggregation process | Comparative Example 2 Aggregation process | Comparative Example 3 Aggregation process | Example 4 Aggregation process | Comparative Example 4 Aggregation process |
|---|---|---|---|---|---|---|---|---|
| Transfer efficiency % | 87.5 | 99.2 | 95.2 | 99.9 | 94.4 | 93.5 | 99.9 | 90.5 |
| Continious duplication test | A | A | C | A | D | D | A | E |

The invention provides a toner for developing an electrostatic image, a developer for developing an electrostatic image, a process for producing them, and a process for forming an image that provide excellent developing and transferring performance and also provide excellent performance stability, as well as high image quality and reliability. The invention also provides a fine resin particle dispersion and a releasing agent dispersion that are suitable for the process for producing the toner for developing an electrostatic image.

The entire disclosure of Japanese Patent Application No. 2000-49965 filed on Mar. 14, 2000 including specification, claims and abstract is incorporated herein by reference in its entirety.

What is claimed is:

1. A toner for developing an electrostatic image comprising a binder resin and a pigment, particles of the toner having a particle size distribution index on a small particle side GSDpS in number distribution of a particle diameter represented by the following equation (I) of about 1.27 or less:

$$GSDpS=D50p/D16p \quad (I)$$

wherein D50p represents a particle diameter providing a particle diameter accumulation in number distribution of 50%, and D16p represents a particle diameter providing a particle diameter accumulation in number distribution of 16% from a small diameter side.

2. A toner for developing an electrostatic image as claimed in claim 1, wherein the toner particles have a surface property index represented by the following equation (II) of 2.0 or less:

$$\text{(Surface property index)}=\text{(Measured specific surface area)}/\text{(Calculated specific surface area)} \quad (II)$$

wherein (Calculated specific surface area) is $6E(n\times R^2)/[\rho\times E(n\times R^3)]$, wherein n represents a number of particles in a channel of a Coulter counter, R represents a channel particle diameter in a Coulter counter, and ρ represents a density of a toner.

3. A toner for developing an electrostatic image as claimed in claim 1, further comprising a releasing agent.

4. A process for producing a toner for developing an electrostatic image, the process comprising the steps of:

forming a first resin particle dispersion containing binder resin particles;

forming aggregated particles by aggregating the first particles; and fusing the aggregated particles, by heating, to form toner particles having a particle size distribution index on a small particle side GSDpS in number distribution of a particle diameter represented by the following equation (I) of about 1.27 or less:

$$GSDpS=D50p/D16\,p \quad (I)$$

wherein D50p represents a particle diameter providing a particle diameter accumulation in number distribution of 50%, and D16p represents a particle diameter providing a particle diameter accumulation in number distribution of 16% from a small diameter side.

5. A process for producing a toner for developing an electrostatic image as claimed in claim 4, the process further comprising the step of:

mixing the first resin particle dispersion containing binder resin particles and a second dispersion having second particles containing colorant particles dispersed therein, so as to obtain aggregated particles.

6. A process for producing a toner for developing an electrostatic image as claimed in claim 5, wherein the colorant particles have a volume average particle diameter from 70 to 250 nm.

7. A process for producing a toner for developing an electrostatic image as claimed in claim 5, the process further comprising:

preparing a third dispersion having releasing agent particles dispersed therein; and mixing the third dispersion with the first dispersion and the second dispersion to obtain aggregated particles.

8. A process for producing a toner for developing an electrostatic image as claimed in claim 4, wherein the toner particles have a surface property index represented by the following equation (II) of 2.0 or less:

$$\text{(Surface property index)}=\text{(Measured specific surface area)}/\text{(Calculated specific surface area)} \quad (II)$$

wherein (Calculated specific surface area) is $6E(n\times R^2)/[\rho\times E(n\times R^3))]$, wherein n represents a number of particles in a channel of a Coulter counter, R represents a channel particle diameter in a Coulter counter, and ρ represents a density of a toner.

9. A process for producing a toner for developing an electrostatic image as claimed in claim 4, wherein the binder resin particles have a zeta potential of −50 mV or less in a dispersion of pH 2.5.

10. A process for producing a toner for developing an electrostatic image as claimed in claim 4, wherein the binder resin particles have a volume average particle diameter from 100 to 400 nm.

11. A process for producing a toner for developing an electrostatic image as claimed in claim 7, wherein the releasing agent particles dispersed in the third dispersion have a volume average particle diameter from 100 to 300 nm.

12. A process for producing a toner for developing an electrostatic image as claimed in claim 11, wherein the third dispersion having the releasing agent particles dispersed therein has a particle size distribution index on a small particle side GSDvS and a particle size distribution index on a large particle side GSDvL in volume distribution of a particle diameter represented by the following equation (III) and (IV), respectively, both of which is about 2.0 or less:

$$GSDvS=D50v/D16v \quad (III)$$

wherein D50v represents a particle diameter providing a particle diameter accumulation in volume distribution of 50%, and D16v represents a particle diameter providing a particle diameter accumulation in volume distribution of 16% from a small diameter side $$GSDvL=D50v/D84v \quad (IV)$$

wherein D50v represents a particle diameter providing a particle diameter accumulation in volume distribution of 50%, and D84v represents a particle diameter providing a particle diameter accumulation in volume distribution of 84% from a small diameter side.

13. A toner as claimed in claim 1, said toner having a shape factor SF1 of about 100 to about 130 where $$SF1=(ML^2/A)\times(\Pi/4)\times100$$

wherein ML represents an absolute maximum length of the toner particles and A represents a projected area of the toner particles.

14. A process for producing toner according to claim 4, said toner having a shape factor SF1 of about 100 to about 130 where $$SF1=(ML^2/A)\times(\Pi/4)\times100$$

wherein ML represents an absolute maximum length of the toner particles and A represents a projected area of the toner particles.

15. A releasing agent dispersion comprising a releasing agent dispersed therein, particles of the releasing agent having a volume average particle diameter in a range of about from 100 to 300 nm, and having a particle size distribution index on a small particle side GSDvS and a particle size distribution index on a large particle side GSDvL in volume distribution of a particle diameter represented by the following equations (III) and (IV), respectively both of which is about 2.0 or less:

$$GSDvS=D50v/D16v \quad (III)$$

wherein D50v represents a particle diameter providing a particle diameter accumulation in volume distribution of 50%, and D16v represents a particle diameter providing a particle diameter accumulation in volume distribution of 16% from a small diameter side $$GSDvL=D50v/D84v \quad (V)$$

wherein D50v represents a particle diameter providing a particle diameter accumulation in volume distribution of 50%, and D84v represents a particle diameter providing a particle diameter accumulation in volume distribution of 84% from a small diameter side.

16. A developer for developing an electrostatic image comprising a toner and a carrier, particles of the toner containing a binder resin and a pigment and having a particle size distribution index on a small particle side GSDpS in number distribution of a particle diameter represented by the following equation (I) of about 1.27 or less:

$$GSDpS=D50p/D16p \quad (I)$$

wherein D50p represents a, particle diameter providing a particle diameter accumulation in number distribution of 50%, and D16p represents a particle diameter providing a particle diameter accumulation in number distribution of 16% from a small diameter side.

17. A developer for developing an electrostatic image as claimed in claim 16, the toner particles having a surface property index represented by the following equation (II of 2.0 or less:

(Surface property index)=(Measured specific surface area)/(Calculated specific surface area)

wherein (Calculated specific surface area) is $6E(n\times R^2)/[\rho\times E(n\times R^3)]$, wherein n represents a number of particles in a channel of a Coultor counter, R represents a channel particle diameter in a Coulter counter, and ρ represents a density of a toner.

18. A process for forming an image, comprising the steps of:

forming an electrostatic latent image on an electrostatic image holding member;

developing the electrostatic latent image with a developer to form a toner image on a developer holding member; and transferring the toner image to a transfer material, the developer containing toner particles having a particle size distribution index on a small particle side GSDpS in number distribution of a particle diameter represented by the following equation (I) of about 1.27 or less:

$$GDpS=D50\ p/D16p \quad (I)$$

wherein D50p represents a particle diameter providing a particle diameter accumulation in number distribution of 50%, and D16p represents a particle diameter providing a particle diameter accumulation in number distribution of 16% from a small diameter side.

19. A process for forming an image as claimed in claim 18, wherein the toner particles have a surface property index represented by the following equation (II) of 2.0 or less:

(Surface property index)=(Measured specific surface area)/(Calculated specific surface area) (II)

wherein (Calculated specific surface area) is $6E(n\times R^2)/[\rho\times E(n\times R^3)]$, wherein n represents a number of particles in a channel of a Coulter counter, R represents a channel particle diameter in a Coulter counter, and ρ represents a density of a toner.

20. A developer according to claim 16, said toner having a shape factor SF1 of about 100 to about 130 where $$SF1=(ML^2/A)\times(\Pi/4)\times100$$

wherein ML represents an absolute maximum length of the toner particles and A represents a projected area of the toner particles.

21. A process for forming an image according to claim 18, said toner having a shape factor SF1 of about 100 to about 130 where $$SF1=(ML^2/A)\times(\Pi/4)\times100$$

wherein ML represents an absolute maximum length of the toner particles and A represents a projected area of the toner particles.

* * * * *